US005871333A

United States Patent [19]

Halsey

[11] Patent Number: 5,871,333

[45] Date of Patent: Feb. 16, 1999

[54] TIP CLEARANCE CONTROL

[75] Inventor: Robin W P Halsey, Bristol, Great Britain

[73] Assignee: Rolls-Royce PLC, London, England

[21] Appl. No.: 848,026

[22] Filed: Apr. 28, 1997

[30] Foreign Application Priority Data

May 24, 1996 [GB] United Kingdom ..... 9610916

[51] Int. Cl.[6] ..... F04D 29/18

[52] U.S. Cl. ..... 415/173.1; 415/173.2

[58] Field of Search ..... 415/115, 116, 415/173.1, 173.2, 173.3

[56] References Cited

U.S. PATENT DOCUMENTS

| | | | |
|---|---|---|---|
| 3,452,542 | 7/1969 | Saferstein et al. | 415/115 |
| 3,936,217 | 2/1976 | Travaglini et al. | 415/118 |
| 3,975,901 | 8/1976 | Hallinger et al. | 415/115 |
| 4,214,851 | 7/1980 | Tuley et al. | 415/115 |
| 4,330,234 | 5/1982 | Colley | 415/173.2 |
| 4,334,822 | 6/1982 | Rossmann | 415/173.2 |
| 5,601,402 | 2/1997 | Wakeman et al. . | |
| 5,685,693 | 11/1997 | Sexton et al. | 415/173.1 |

FOREIGN PATENT DOCUMENTS

| | | |
|---|---|---|
| A-2-509373 | 1/1983 | France . |
| 2-117-451 | 10/1983 | United Kingdom . |
| 2 169 962 | 1/1985 | United Kingdom . |
| A-2-195715 | 4/1988 | United Kingdom . |
| 2-253-012 | 8/1992 | United Kingdom . |

*Primary Examiner*—John T. Kwon
*Attorney, Agent, or Firm*—Oliff & Berridge, PLC

[57] ABSTRACT

A tip clearance control system operated by differential air pressure has a movable shroud liner segment assembly which forms the inner circumference of an annular pressure chamber encircling the blades of a rotary stage. High pressure air is bled into the chamber from a source of HP compressor delivery air through small holes. The chamber may be vented rapidly through an electrically controlled valve into the engine bypass duct. When the valve is opened pressure in the chamber is dropped quickly below gas path pressure to move the shroud liner segments radially outwards thereby increasing blade tip clearance.

16 Claims, 3 Drawing Sheets

TIP CLEARANCE CONTROL

The invention relates to a blade tip clearance control system for a rotary stage of a gas turbine engine. In particular, the invention concerns a blade tip clearance control system for a turbine stage and which is driven by fluid pressure in the internal air cooling system. A clearance control system which utilises fluid pressure is known from our earlier published UK patent application GB 2169 962A. In this earlier disclosed arrangement the shroud liner segments of a compressor rotary stage are supported by a movable diaphragm member behind which there is a chamber which is connected via pipework with a valve which can connect the chamber alternatively with a source of fluid pressure or vent it to a region of low pressure. Thus, by controlling the pressure in the chamber the diaphragm may be displaced to move the shroud liner segments. However, the additional pipework and diaphragm etc adds weight and introduces further components with their own associated risks of failure. The present invention has among its objectives the achievement of an equivalent degree of tip clearance control while avoiding, or at least minimising the penalties of additional weight and increased risk of failure.

Accordingly the present invention provides a pressure actuated tip clearance control system for a shroud structure of a gas turbine engine rotary stage comprising an annular plenum chamber formed between an annular shroud liner arrangement on the inner circumference of the chamber and a generally cylindrical casing on the radially outer side into which, in use, fluid is bled into the chamber at a pressure higher than pressure in the gas path in order to contract the shroud liner assembly, and valve means for venting the plenum chamber to a pressure lower than the gas path pressure in order to expand the shroud liner circumference for increased tip clearance.

Preferably, during engine operation, fluid is bled continuously into the plenum chamber. The fluid is preferably drawn from a source of high pressure compressor delivery air.

The invention, and how it may be constructed and operated, will now be described in greater detail with reference, by way of example, to an embodiment illustrated in the accompanying drawings, in which.

The drawings illustrate a portion of a high pressure turbine stage of a bypass gas turbine engine. The overall construction and operation of the engine is of a conventional kind, well known in the field, and will not be described in this specification beyond what is necessary to gain an understanding of the invention.

Rotary turbine stages can be broadly divided into two categories as shrouded and shroudless. In shrouded turbines the radially outer ends of the turbine blades carry circumferentially extending shroud segments which abut each other to form an effectively continuous shroud ring which defines the gas path wall between corresponding portions of upstream and downstream guide vane structures. In a shroudless turbine stage, with which we are presently concerned, the blades are unencumbered by shroud ring segments. Instead the gas path is defined by a static shroud ring assembly which is usually supported on either side by the upstream and downstream guide vane assemblies. A gap exists between the blade tips and the inner surface of the static shroud ring which varies in size during an engine operational cycle due to different rates of expansion and contraction. Leakage across the blade tips represents a loss of efficiency so, obviously, there are advantages to be gained from minimising this gap at all times or whenever possible. It is known to mount the various guide vane rings on static discs which mirror the thermal expansion characteristics of the turbine discs. By this means relatively long time constant and steady state effects are compensated, but transient effects such as centrifugal growth arising from slam accelerations, for example, must be catered for in other ways.

One way of dealing with transient blade tip rubs, which the presently described invention also utilises as will be described, is to provide a layer of abradable material on the inside of the shroud ring segments and allow the blade tips to wear a track when tip rubs occur. The blades may even be provided with abrasive tips for the purpose. Another way is to actively move the shroud segments when incipient tip rub conditions arise. One such system which utilises differential fluid pressures to provide actuation forces to move the shroud segments is described in the aforementioned UK Patent GB 2169962.

Figure 1:
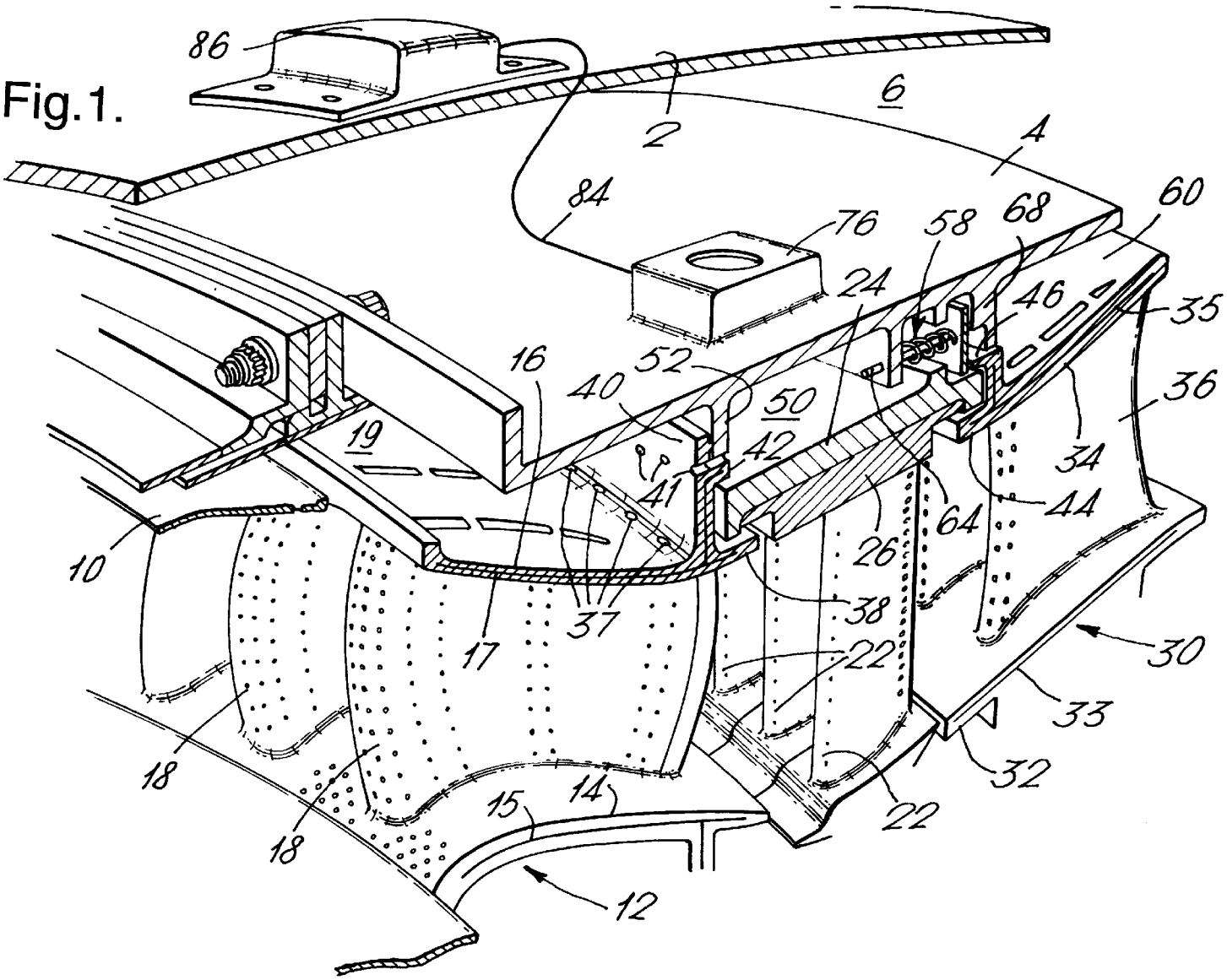
FIG. 1 shows a perspective view of a partly cutaway turbine stage.
Figure 2:
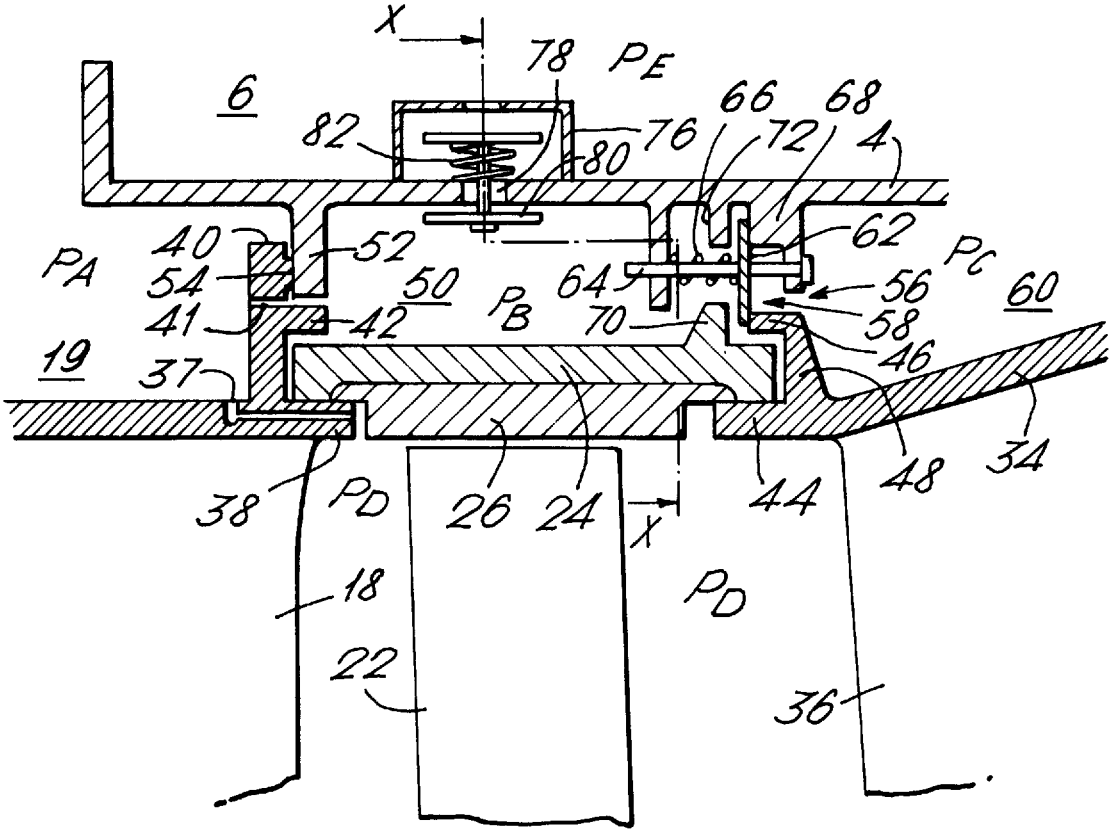
FIG. 2 shows a diagrammatic view on a radial section of the shroud liner arrangement of FIG. 1.

Referring now to FIG. 1 of the accompanying drawings there is shown a detailed perspective view through the first, high pressure turbine stage of a bypass gas turbine aeroengine. A section of a generally cylindrical engine outer casing is indicated at 2 and an adjacent section of a concentric inner casing at 4, the annular space 6 between the inner and outer casings 2,4 constitutes the engine bypass duct. Towards the left in the drawing lies an annular combustion chamber of which the downstream ends of the combustion chamber inner and outer casings are visible at 8 and 10 respectively. Next in the gas path is the outlet nozzle guide vane annulus, a section of which is generally indicated at 12, consisting of concentric inner and outer platforms 14,16 respectively and a series of guide vanes 18 extending radially between the platforms and spaced apart around the nozzle annulus. The inner surfaces of platforms 14,16 continue smooth flow path walls from combustor casings 8,10 respectively. The annular volume 19 formed by the space between the outer vane platforms 16 and the inner casing 4 constitutes a chamber which opens into the high pressure casing surrounding the combustion chamber itself.

Downstream of outlet guide vane annulus 12 is a high pressure, or first, turbine rotary stage 20 consisting of a multiplicity of shroudless turbine blades 22 mounted on a disc (not shown). Encircling the annular array of turbine blades 22 is an annular shroud liner assembly consisting of a plurality of shroud liner segments 24 mounted in end to end abutment in a circumferential direction. Each shroud liner segment 24 carries on its inner face a layer 26 of abradable material into which the tips of the blades 22 can wear a track, or groove, in the event of a tip rub occurring. Next downstream in the gas path is a second annular array of guide vanes, generally indicated at 30. Again this array consists of inner and outer concentric platforms 32,34 and a series guide vanes 36 extending radially between the platforms and spaced apart in a circumferential direction.

The shroud liner segments 24 are supported by portions of the guide vane outer platforms 16,34 the upstream and downstream circumferential edges of the liner segments. In more detail, the outer platform 16 of an upstream guide vane segment 12 has a trailing edge 38 which extends in a downstream direction. A short distance back from this edge and on the outside of the platform there is formed an upstanding, circumferential flange 40 which extends towards the inner engine casing 4. At an intermediate height the flange 40 has formed on its downstream side an axially extending projection 42 which is thus parallel to but spaced from the guide vane trailing edge 38. In the assembled arrangement the upstream margin of a shroud liner segment 24 is located between these two parts 38,42 which function radial stops to limit the movement of the liner segment 24.

A plurality of small bleed holes 37 are formed through the trailing edge 38 of the vane platform. These bleed holes lead from the volume 19 to a clearance gap between the edge 38 and the edge of the shroud layer 26. When the shroud liner 24 is against the radially outer stop 42 the small gap which is thereby opened is shielded from the incursion of exhaust gas by a permanent flow of cooler air through holes 37 driven by the permanent pressure gradient between pressure regions 19 and the gas path.

In similar fashion, the liner segment 24 is also limited in its movement at its downstream edge by an upstream margin 44 of outer guide vane platforms 34, which acts as a radially inner stop, and by an axial projection 46 carried by upstanding flanges 48, which acts as a radially outer stop. The liner segments 24 are thus restrained to limited radial movement by the pairs of stops 38,42 and 44,46.

As mentioned above the liner segments 24 constitute the movable inner wall of an annular plenum chamber 50. The outer circumferential wall of the chamber is formed by an annular section of the engine inner casing 4 and is bounded on its upstream side by the upstanding guide vane flange 40 and co-operating flange 52 projecting radially inwards from the casing 4. These two flanges 40,52 partly overlap and the gap between them is closed by a chordal seal 54 on the concealed face of the flange 40. The guide vane segments 12 are mounted in place by known means (not shown) comprising a thermally responsive expansion ring to which flanges on the underside of the inner platforms 14 are bolted. The expansion ring is warmed and cooled by compressor bleed air so that its radial growth matches the thermal growth of the rotary disc on which blades 22 are mounted. The chordal seal 54 is urged against flange 52 by gas pressure to form a seal, while the overlap depth of the flanges on either side of the chordal seal ensures that sealing engagement is maintained notwithstanding the effects of differential thermal expansion.

On the downstream side of the plenum chamber 50 a gap 56 is maintained between the uppermost edge of the stop 46 on outer platform 34 and the innermost edge of a flange 68 on engine casing 4. However, it is necessary to maintain a leakage flow around the downstream margin of the shroud liner segments 24 under all conditions in order to prevent hot exhaust gas incursion. Therefore, for reasons which will become more apparent below a two-way valve 58 is provided at the downstream side of plenum chamber 50 so that a flow of relatively cool fluid is sourced alternatively from the chamber 50 or from a region 60 bounded by the downstream guide vane platforms 34 and the engine casing 4.

The two-way valve 58, in the example being described, consists of a flapper seal comprising a plurality of part annular seal plates, generally indicated at 62, slidably mounted on pins 64. The seal plates 62 are biased by springs 66, supported on the pins 64 towards a first position in which the plates seal against part 46 on the downstream guide vane platform 34 and a flange 68 on the inside of the engine casing 4. However, the plates 62 are movable against the spring bias, by differential fluid pressure on opposite sides of the plates, to a second seal position in which the plates seal against an abutment 70 carried towards the downstream a margin of the shroud liner segments and a further flange 72 on the inside of the engine casing 4. The seal contact faces of the flanges 68 and 72 on the casing are spaced about the same distance apart and roughly aligned with the seal contact faces of the abutments 70 on the shroud liner segments and the part 46 carried by the vane platform 34.

Figure 3:
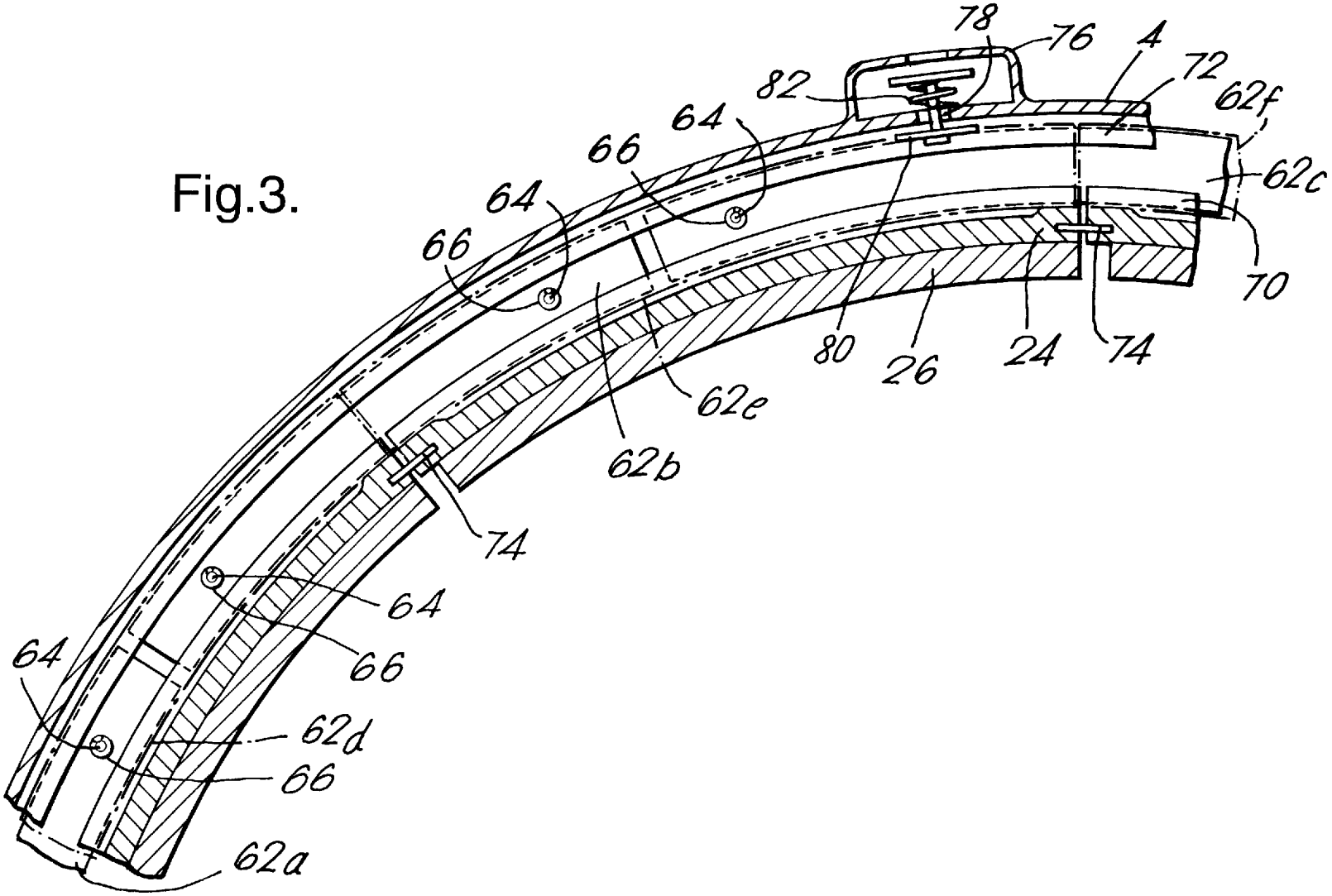
FIG. 3 shows an axial view on line X—X in FIG. 2.

Referring now to FIG. 3, this shows a view of a part circumferential section of two-way valve 58 viewed in a downstream direction from within plenum chamber 50, to illustrate better the arrangement of the seal plates. The plates are arranged in two overlapping staggered rows to provide mutual sealing of gaps between the ends of adjacent plates. Thus, in the drawing a first row comprises plates 62*a–c* and overlapping these a second row of plates 62*d–f*. By this arrangement the valve 58 seals equally well in either direction.

Also visible in FIG. 3 are conventional strip seals 74 inserted between abutting edges of the shroud liner segments 24. Similar strip seals (not shown) are also inserted between abutting edges of both upstream and downstream guide vane segments. Although the seal strips are not shown, receiving slots 15,17,33 and 35 are indicated in the vane platform edges 14,16,32,34 respectively.

Finally, valve means is provided to selectively vent the plenum chamber 50 comprising a plurality of valves 76 spaced apart around the engine casing 4. For example there may be four such valves. Associated with each of the valves 76 there is a valve aperture 78 formed through engine casing 4 providing a vent passage from the chamber 50 into the bypass duct 6. This aperture is closable by a valve member 80 operated by electric valve actuator means 82 connected, as shown in FIG. 1, by a signal wire 84 to a digital engine control unit (DECU) 86 mounted on the exterior of the outer engine casing 2.

For the purposes of describing the operation of the above arrangement, let us assume that initially the gas turbine engine is operating normally in a cruise speed setting. The nozzle guide vanes 18 are cooled by HP compressor bleed air in the upstream chamber 19, let the pressure of air in this chamber be represented by $P_A$. Let the pressure of cooling air in the downstream chamber 60 be represented $P_C$. A small proportion of this cooling air passes via bleed holes 41 through flange 40 into plenum chamber 50. At this time the vales 76 are closed so the pressure $P_B$ in the plenum chamber 50 will tend to rise gradually. Its theoretical maximum valve is equal to $P_A$ assuming no leakage from chamber 50, which is not the case. When the force exerted by pressure $P_B$ plus the force exerted by springs 66 on seal plates 62 exceeds the opposing force due to pressure $P_C$ in chamber 60, then the seal plates are urged against flanges 68 and 46 thus sealing the annular gap 56.

Thus leakage from chamber 50 is substantially wholly via the gap between the downstream margin of the shroud liner segments 24 and the interior of the concave recess created by flange 48 and shroud movement stops 44,46. This leakage is, in fact, desirable to establish a low level effusion cooling flow over the leading edge 44 of the vane platform 34. Thus, by the prevailing conditions $$P_A > P_B > P_C$$

Since fluid pressure $P_D$ in the gas path is relatively low and, in these conditions, lower than in the chamber 60 that is: $P_B > P_D$ then there is a net force exerted on the shroud liner segments 24 by the pressure $P_B$ urging the segments radially inwards against the stops 38,44. This results in minimum tip clearance over the blades 22. It is also to be noted that fluid pressure $P_E$ in the bypass duct 6 is very low, so that:

$$P_B >> P_E$$

Now, when it is required to increase the tip clearance rapidly to accommodate increased blade tip radius growth due to, say, a slam acceleration then the vales 76 are opened.

The plenum chamber 50 depressurises rapidly and $P_B$ falls below $P_D$ so that forces acting on the underside of shroud liner segments 24 due to gas path pressure pushes the segments radially outwards thereby increasing blade tip clearance gap. Thus, in this condition $$P_B \ll P_D$$

$$\text{while } P_A > P_B < P_C$$

The altered distribution of pressure also results in the two-way valve 58 flipping-over to seal against flange 72 and shroud carried abutment 70 thereby sealing the leakage path from chamber 50 but, at the same time, providing a substitute leakage path from chamber 60 to supply the effusion cooling flow over platform 34.

Increased tip clearance, or at least, this radially outward location of the shroud liner segments will be maintained as long as these last mentioned pressure conditions persist. At some point in time it will become possible to restore the shroud segments to the initially described position, indeed it will be desirable in order to recover turbine efficiency. At this time the actuation signal on line 84 may be used to close valves 76 resealing chamber 50. High pressure air is continuously bleeding into chamber 50 through inlet holes 41 from region 19 gradually restoring the pressure $P_B$ to its former level. At some point $P_B$ becomes roughly equal to $P_C$ and the valve 58 flips back re-establishing low level leakage flow from chamber 50. Thus, it will be understood that this tip clearance control system operates on leakage flow levels of cooling air and no additional flow or loss of cooling air is involved. Although the air in the chamber 50 is vented into the bypass duct 6 and is totally lost, the chamber is subsequently recharged by the existing leakage flow through holes 41. Also the flow levels past the downstream edge of the shroud liner segments through the gap against the vane platform edge 44 are normal leakage flows only.

I claim:

1. A pressure actuated tip clearance control system for a shroud structure of a gas turbine engine rotary stage lying between upstream and downstream stator assemblies comprising an annular plenum chamber formed between a movable annular shroud liner arrangement on the inner circumference of the chamber and a generally cylindrical casing forming the radially outer side of the plenum chamber, a source of high pressure compressor delivery air at a pressure higher than pressure in the gas path, a plurality of apertures in an upstream wall of the chamber operative, in use, to continuously bleed fluid from the source of high pressure compressor delivery air into the plenum chamber in order to contract the movable shroud liner assembly, valve means for venting fluid from the plenum chamber to a region of pressure lower than the gas path pressure in order to expand the movable shroud liner assembly for increased tip clearance, a leakage path between a downstream side of the movable shroud liner arrangement and the downstream stator assembly, and further two-way valve means adapted to connect said leakage path with alternative sources of fluid to maintain continuous fluid flow in the leakage path, the alternate sources of fluid comprising the plenum chamber when it is charged with high pressure or a further pressure region when the plenum chamber is vented.

2. A pressure actuated tip clearance control system as claimed in claim 1 wherein the valve means has a total outlet aperture area greater than the inlet area of fluid flow into the plenum chamber.

3. A pressure actuated tip clearance control system as claimed in claim 2 wherein the valve means comprise a plurality of individual valves spaced apart around the plenum chamber.

4. A pressure actuated tip clearance control system as claimed in claim 1 wherein the further two-way valve means is provided in the downstream wall of the plenum chamber leading to a region of relatively low pressure.

5. A pressure actuated tip clearance control system as claimed in claim 4 wherein the further two-way valve means comprise a plurality of annular seal plate segments mounted end to end abutment in a circumferential direction.

6. A pressure actuated tip clearance control system as claimed in claim 5 wherein the further two-way valve means comprises a double row of seal plates and the plates of the second row overlap abutting ends of the plates for the first row to seal leakage therethrough.

7. A pressure actuated tip clearance control system as claimed in claim 4 wherein the further two-way valve means is located adjacent the leakage path into the gas path at the downstream side of the shroud liner arrangement and said further two-way valve means is adapted to connect said leakage path alternatively with the plenum chamber when charged with high pressure or with the downstream low pressure region when the plenum chamber is vented.

8. A pressure actuated tip clearance control system as claimed in claim 1 wherein the further two-way valve means operates automatically to connect the leakage path to the plenum chamber or the further pressure region according to the relative pressures therein.

9. A pressure actuated tip clearance control system as claimed in claim 8 wherein the further two-way valve means comprises a plurality of annular seal plate segments mounted in end to end abutment in a circumferential direction.

10. A pressure actuated tip clearance control system as claimed in claim 9 wherein the further two-way valve means comprises a double row of seal plates and the plates of the second row overlap abutting ends of the plates of the first row to seal leakage therethrough.

11. A pressure actuated tip clearance control system as claimed in claim 9 wherein the seal plates of the further two-way valve means alternatively abut the downstream stator assembly or the movable annular shroud liner arrangement.

12. A pressure actuated tip clearance control system as claimed in claim 10 wherein the seal plates of the further two-way valve means alternatively abut the downstream stator assembly or the movable annular shroud liner arrangement.

13. A pressure actuated tip clearance control system as claimed in claim 9 wherein the seal plates are biased towards the movable annular shroud liner arrangement whereby a bias force is opposed by pressure in the plenum chamber.

14. A pressure actuated tip clearance control system as claimed in claim 10 wherein the seal plates are biased towards the movable annular shroud liner arrangement whereby a bias force is opposed by pressure in the plenum chamber.

15. A pressure actuated tip clearance control system as claimed in claim 11 wherein the seal plates are biased towards the movable annular shroud liner arrangement whereby a bias force is opposed by pressure in the plenum chamber.

16. A pressure actuated tip clearance control system as claimed in claim 12 wherein the seal plates are biased towards the movable annular shroud liner arrangement whereby a bias force is opposed by pressure in the plenum chamber.

* * * * *